United States Patent [19]

Vinegar et al.

[11] Patent Number: 4,540,882

[45] Date of Patent: Sep. 10, 1985

[54] METHOD OF DETERMINING DRILLING FLUID INVASION

[75] Inventors: Harold J. Vinegar; Scott L. Wellington, both of Houston, Tex.

[73] Assignee: Shell Oil Company, Houston, Tex.

[21] Appl. No.: 566,441

[22] Filed: Dec. 29, 1983

[51] Int. Cl.[3] ..... G01V 5/00

[52] U.S. Cl. ..... 250/255

[58] Field of Search ..... 250/254, 255; 378/4; 73/153

[56] References Cited

U.S. PATENT DOCUMENTS 4,029,963 6/1977 Alvarez et al. ..... 250/360

OTHER PUBLICATIONS

Selective Iodine Imaging Using K-edge Energies in Computerized X-Ray Tomography, S. J. Riederer et al., Medical Physics, vol. 4, No. 6, Nov./Dec. 1977, pp. 474–481.

Selective Material X-Ray Imaging Using Spatial Frequency Multiplexing, A. Macovski et al., Applied Optics, vol. 13, No. 10, Oct. 1974, pp. 2202–2208.

*Primary Examiner*—Alfred E. Smith
*Assistant Examiner*—Vincent J. Lemmo

[57] ABSTRACT

A method of determining the invasion of drilling fluid into a core sample taken from a borehole. A first material is added to the drilling fluid to obtain a first fluid that has an effective atomic number that is different than the effective atomic number of the connate fluids in the rock formation surrounding the borehole. A preserved core sample is collected from the borehole for scanning by a computerized axial tomographic scanner (CAT) to determine the attenuation coefficients at a plurality of points in a cross section of the core sample. The preserved core sample is scanned with a CAT at first and second energies, and the determined attenuation coefficients for the plurality of points in the cross section at each energy are used to determine an atomic number image for the cross section of the core sample. The depth of invasion of the first fluid is then determined from the atomic number image, as an indication of the depth of invasion of the drilling fluid into the core sample.

25 Claims, 8 Drawing Figures

FIG. 4
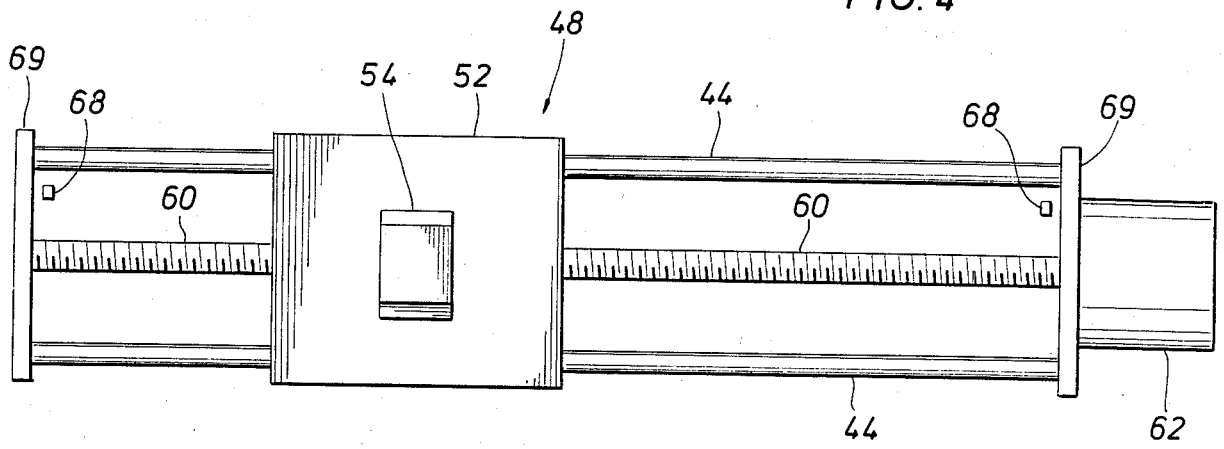
FIG. 5
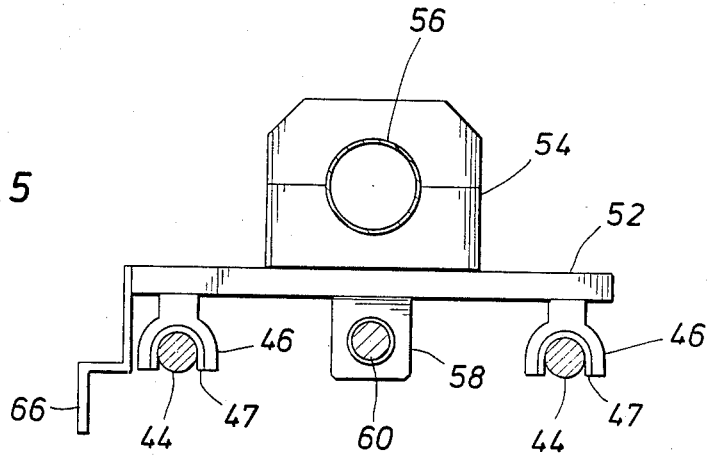
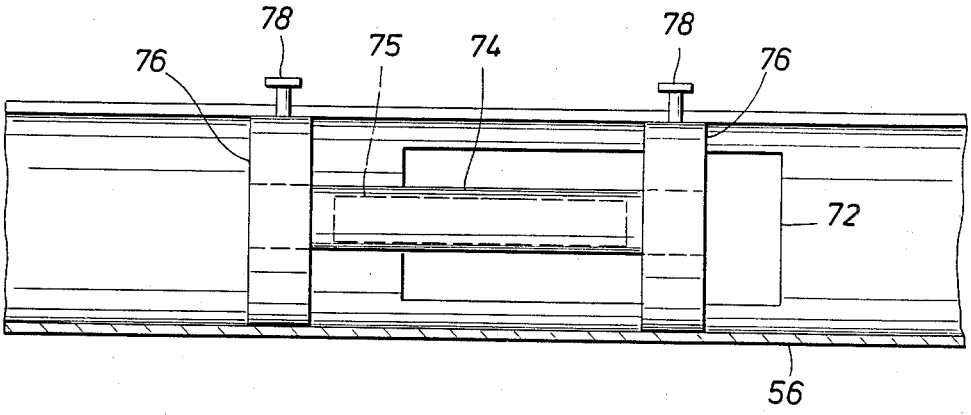
FIG. 6

METHOD OF DETERMINING DRILLING FLUID INVASION

BACKGROUND OF THE INVENTION

This invention relates to determining the invasion of drilling fluid into a core sample taken from a borehole.

When a well is drilled into a permeable formation a portion of the drilling fluid enters the formation and displaces the connate fluids, both brine and hydrocarbons, away from the borehole. It is important to know the depth of invasion, since all logging tools have some degree of sensitivity to the invaded zone. A core sample taken at depth will also experience this invasion. It is standard practice in the industry to analyze core samples to determine the depth of invasion into the core. It is also important to determine the depth of invasion into the core to know what portion of the core has been unaltered by the drilling fluid and therefore is representative of the unaltered formation.

Prior art workers have added tritium to the drilling fluid to determine the invasion of the drilling fluid into the core sample. In this method a core sample is cored from the borehole. A selection of the samples is cut from this core sample at increasingly radial distances from the center. Each of the cut samples is crushed, and the water in that sample is removed. The water from each sample is measured for approximately twenty-four hours with a Geiger counter to determine the radioactivity in that sample. A profile of the tritium invasion into the core sample is then plotted as a indication of the invasion of the drilling fluid into the formation. However, it has been found that this method provides less than desirable results, is time-consuming, has a large degree of statistical uncertainty, requires the handling of radioactive materials at the borehole and does not provide a cross-sectional view of the invasion.

Therefore, it is an object of the present invention to provide a method of determining the depth of invasion of the drilling fluid into a core that overcomes disadvantages and inaccuracies of the prior art.

SUMMARY OF THE INVENTION

In accordance with the present invention there is provided a method of determining the invasion of drilling fluid into a core sample taken from a borehole. A first material is added to the drilling fluid to obtain a first fluid that has an effective atomic number that is different than the effective atomic number of the connate fluids in the rock formation surrounding the borehole. A preserved core sample is collected from the borehole for scanning by a computerized axial tomographic scanner, hereinafter referred to as "CAT", to determine the attenuation coefficients at a plurality of points in a cross section of the core sample. It should be noted that as used herein "preserved" core sample shall mean a core sample that has been frozen or pressurized so that connate gases and liquids are not lost from the core. The preserved core sample is scanned with a CAT at first and second energies and the determined attenuation coefficients for the plurality of points in the cross section at each energy are used to determine an atomic number image for the cross section of the core sample. The depth of invasion of the first fluid is then determined from the atomic number image, as an indication of the depth of invasion of the drilling fluid into the core sample.

In the method of the present invention a material, such as barium sulfate, calcium carbonate, sodium tungstate or sodium iodide, is added to the drilling fluid in sufficient quantities to obtain a drilling fluid that has an effective atomic number that is different than the effective atomic number of the connate fluids, that is, brine and hydrocarbons, in the rock formation surrounding the borehole. Generally, an effective atomic number greater than approximately 7.5 is suitable for most applications. If the drilling fluid is oil based rather than water based, then a material such as iodated oil is added.

One scan is performed at an energy that is low enough to be predominantly in the photoelectric region, that is, less than 80 keV mean energy, and the other scan is performed at an energy that is high enough to be predominantly in the Compton region, that is, greater than 80 keV mean energy. Either pre-imaging or post-imaging techniques can be applied to the attenuation coefficients obtained by the dual energy scans to determine the effective atomic number of the core sample. The depth of invasion of the drilling fluid into the core can be determined by an operator who reviews the atomic image to determine the invasion for each cross section analyzed. Alternatively, the CAT system controller and data processing equipment can implement a method which automatically determines the portion of the core that has been invaded by the drilling fluid. In this method the average effective atomic number is determined for a reference area near the center of the core sample and for a plurality of areas that are positioned at different distances from the center of the core sample. The average effective atomic number for the reference area is compared with the average effective atomic number for the plurality of areas to determine which of the plurality of areas has an average effective atomic number that is greater than the average effective atomic number of the reference area by a predetermined amount as an indication of the depth of drilling fluid invasion.

The present invention also provides an alternate method of determining the invasion of drilling fluid into the core sample. In this method a first material which has a K-edge at a first energy is added to the drilling fluid. A cross section of the preserved core sample is then scanned at a second energy that is less than the first energy and at a third energy that is greater than the first energy. The attenuation coefficients determined for the core sample at the second and third energies are used to determine a concentration map of the first material in that cross section. This concentration map is then used to determine the depth of invasion of the drilling fluid. The concentration map of the first material can be reviewed by an operator, or the methods described hereinabove can be applied to the average concentration of a reference area and plurality of areas located at different distances from the center of the core sample. In one embodiment the core sample is radiated with radiation at the second and third energies. In an alternative embodiment a filter can be used to filter the higher energy radiation to obtain the lower energy radiation. Preferably, the filter has a K-edge at or near the first energy. Still further, a second filter which has a K-edge at an energy that is higher than the first energy can be used to filter the higher energy radiation. The material added to the drilling fluid can be, for example, sodium tungstate, which has a K-edge at 69.5 keV. Preferably, a tungsten filter is used in the case of sodium tungstate since it has the same K-edge; however, another filter, such as a tantalum filter which has a K-edge of 67.4 keV, can be used.

Other objectives, advantages and applications of the present invention will be made apparent by the following detailed description of the preferred embodiments of the present invention.

BRIEF DESCRIPTION OF THE DRAWINGS

FIG. 4 is a top view of the motorized side of the sample holding apparatus.

FIG. 5 is a cross sectional view taken along lines 5—5 of FIG. 2.

FIG. 6 is a side view of the tube and cylinder portion of the sample holding apparatus.

DETAILED DESCRIPTION OF THE PREFERRED EMBODIMENTS

Figure 1:
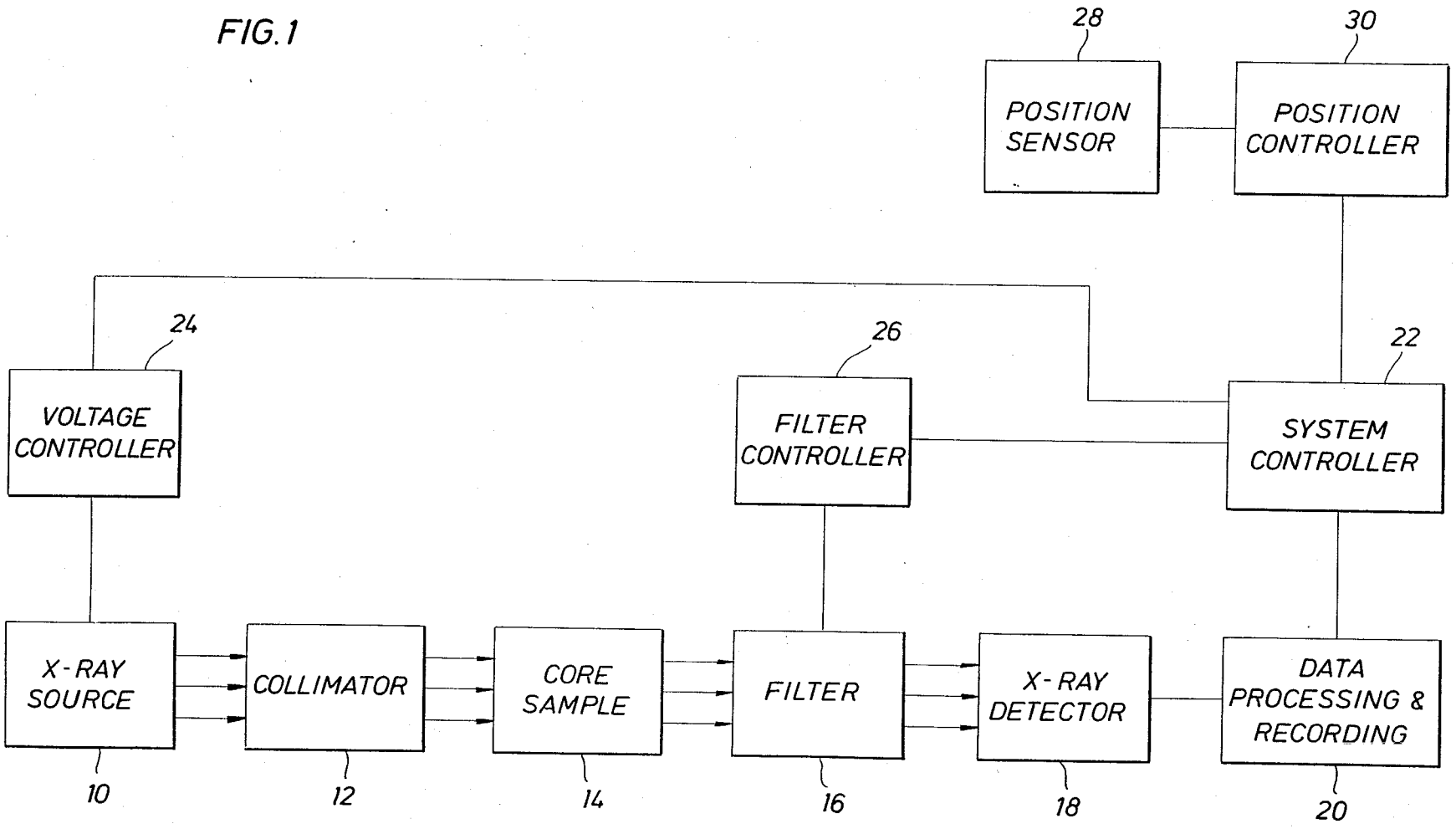
FIG. 1 is a block diagram of a computerized axial tomographic analyzer suitable for use in the method of the present invention.
Figure 2:
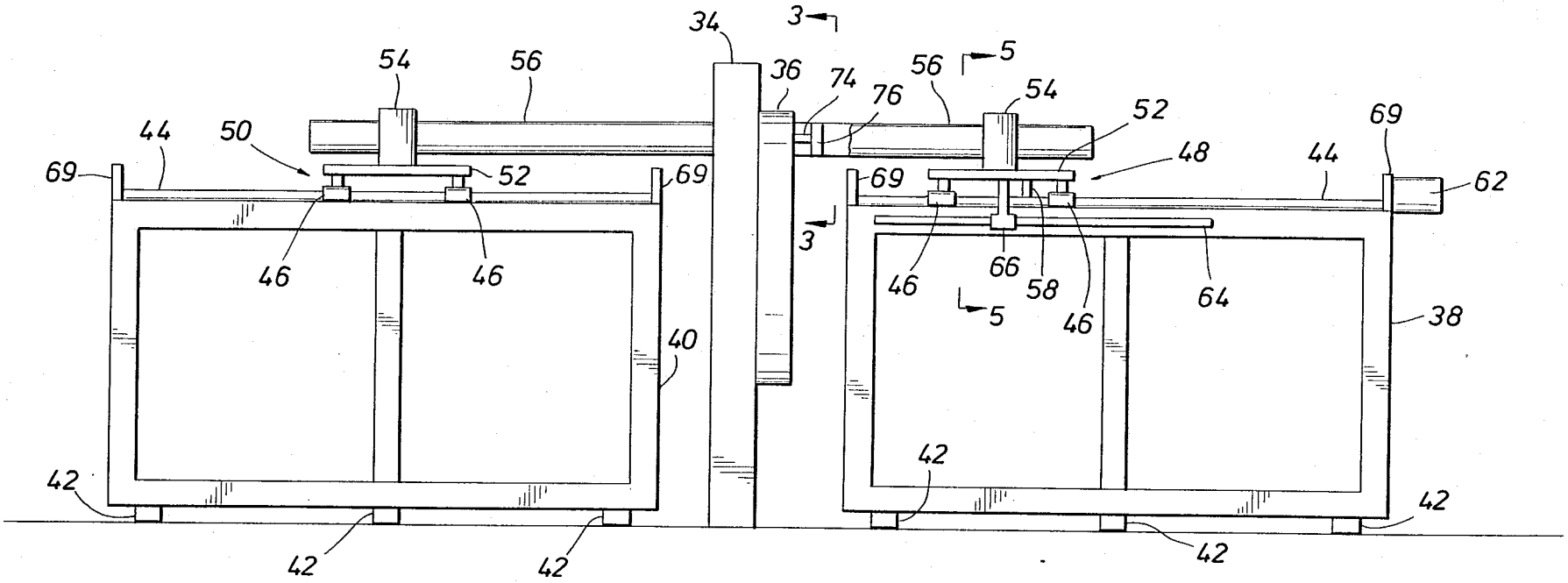
FIG. 2 is a side view of the sample holding apparatus employed with the computerized axial tomographic analyzer.
Figure 3:
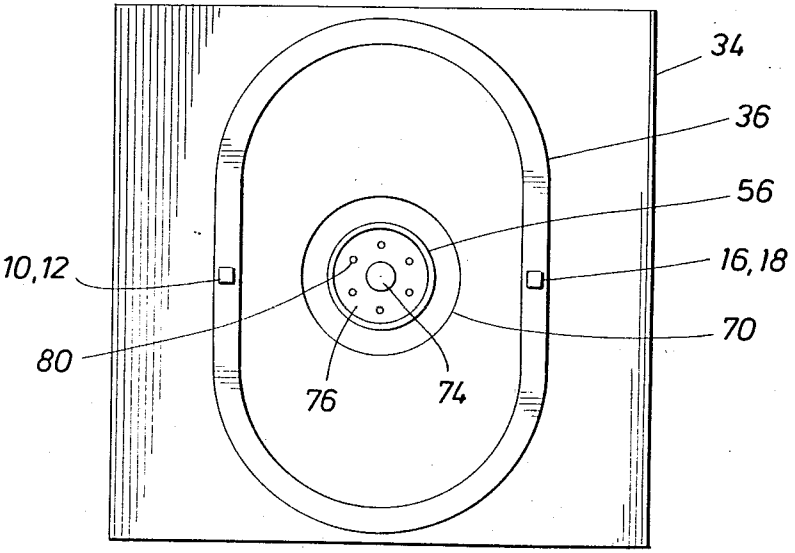
FIG. 3 is a cross sectional view taken along lines 3—3 of FIG. 2.

Referring to FIG. 1, a typical CAT suitable for use in the method of the present invention employs an X-ray source 10 to provide X-rays which are indicated by a plurality of arrows; these X-rays are collimated by collimator 12 prior to passing through core sample 14. After the X-rays have passed through core sample 14, they are filtered by filter 16 which can be, for example, air, tungsten or copper. Alternatively, filter 16 can be applied to the X-rays prior to their entering core sample 14 rather than after their passage through core sample 14. The filtered X-rays are then detected by X-ray detectors 18 which generate signals indicative thereof; these signals are provided to suitable data processing and recording equipment 20. The entire operation, from the generation of the X-rays to the processing of the data is under the control of system controller 22. Suitable signals are provided by system controller 22 to voltage controller 24 which controls the voltage applied to X-ray source 10, thereby controlling the energy range of the X-rays. Alternatively, filter 16 can be used to vary the energy range as is known in the art. System controller 22 also provides suitable control signals to filter controller 26 to apply the appropriate filter to the X-rays which have passed through core sample 14 before they are detected by X-ray detector 18. The point along core sample 14 that is being analyzed is detected by sample position sensor 28 which provides signals indicative thereof to sample position controller 30. System controller 22 provides signals which are indicative of the desired point along core sample 14 or the amount of advancement from the last point analyzed, to sample position controller 30, which moves core sample 14 to the proper location.

Referring now to FIGS. 2–6, a suitable CAT and sample positioning system for use in the present invention is shown in detail. A typical CAT, for example, the Deltascan-100 manufactured by Technicare Corporation of Cleveland, Ohio is indicated by numeral 34. CAT 34 has a gantry 36 which contains X-ray source 10, collimator 12, filter 16 and X-ray detectors 18. Support structures or tables 38 and 40 are located on opposite sides of CAT 34 and have legs 42 which are suitably attached to, for example, the floor, to ensure that tables 38 and 40 maintain proper positioning and alignment with CAT 34. Tables 38 and 40 each have a set of guide means or rails 44, such as one inch diameter solid 60 case shafts mounted on shaft supports, Model No. SR-16, both being manufactured by Thomson Industries, Inc. of Manhasset, N.Y., on which the legs 46 of trolleys 48 and 50 ride. Preferably, legs 46 have a contact portion 47 that includes ball bearings in a nylon enclosure, such as the Ball Bushing Pillow Block, Model No. PBO-16-OPN, which are also manufactured by Thomson. Trolleys 48 and 50 have a flat member 52 which is attached to legs 46 such that member 52 is parallel to rails 44. A member 54 which can consist of two pieces fastened together by suitable means, such as screws, is mounted on member 52 and has an aperture suitable for holding tube 56. Member 52 of trolley 48 has a member 58 attached to the bottom portion of member 52 that is provided with suitable screw threads for mating with gear or screw 60. Screw 60 is driven by motor 62 for moving trolley 48 horizontally. Screw 60 can be, for example, a preloaded ball bearing screw, Model No. R-0705-72-F-W, manufactured by Warner Electric Brake & Clutch Company of Beloit, Wis., and motor 62 can be, for example, a DC motor, Model No. 1165-01DCMO/E1000MB/X2, marketed by Aerotech, Inc. of Pittsburgh, Pa. Motor 62 turns a predetermined number of degrees of revolution in response to a signal from sample position controller 30 of FIG. 1, which can be, for example, a Unidex Drive, Model No. SA/SL/C/W/6020/DC-O/F/BR/R*, which is also marketed by Aerotech. Table 38 and trolley 48 also contain an optical encoding position sensing system, for example, the Acu-Rite-II manufactured by Bausch and Lomb Company of Rochester, N.Y., which comprises a fixed ruler or scale 64 attached to table 38 and an eye or sensor 66 attached to member 52 of trolley 48 for determining the position along ruler 64 at which trolley 48 is located. The digital output from optical sensor 66 is provided to sample position controller 30 of FIG. 1 so that sample position controller 30 can compare this with the desired position indicated by the digital signal from system controller 22 and provide appropriate control signals to motor 62 for rotation of screw 60 to accurately position trolley 48. Table 38 can also be provided with limit switches 68 which provide appropriate control signals to sample position controller 30 which limits the length of travel of trolley 48 from hitting stops 69 on table 38.

Tube 56 is centered in the X-ray field 70 of CAT 34. The attachment of tube 56 to members 54 of trolley 48 and 50 by a screw or other suitable fastening means causes trolley 50 to move when trolley 48 is moved by means of screw 60 and motor 62. Tube 56 which preferably is made of material that is optically transparent and mechanically strong and has a low X-ray absorption, for example, plexiglas, has a removable window 72 to facilitate the positioning of sample holder 74 in tube 56. A core sample 75 is positioned in sample holder 74 as indicated by dotted lines. The ends of sample holder 74 are positioned in central apertures of discs 76, which can be made of a low friction material, for example, nylon, and are sized such that they make a close sliding fit to ensure centering of the sample inside tube 56. Discs 76 are locked in position in tube 56 by screws 78 which can be made of, for example, nylon. In addition, discs 76 can be provided with a plurality of apertures 80 sized to accommodate fluid lines and electrical power lines from various equipment associated with sample holder 74.

Sample holder 74 can be a pressure-preserving, core-sample container used in normal coring operations; however, if standard X-ray energy associated with CAT scan analytic equipment, such as the Deltascan-100 mentioned hereinabove, the pressure vessel must be made of material that will allow the X-rays to pass through the container walls, for example aluminum, beryllium or alumina. Aluminum is preferred because it absorbs a portion of the low energy spectra, thus making the beam more monochromatic. Nevertheless, steel pressure containers can be employed if higher energy X-ray tubes or radioactive sources are used. In the case of a frozen core sample the container can be positioned inside an insulating cylinder which can be made of, for example, styrofoam or other insulating materials with low X-ray absorption. This insulating cylinder can be filled with dry ice or the like to keep the core sample frozen. If it is desired to heat a core sample, a heating element which has a low X-ray absoption, such as the heating foil manufactured by Minco Products, Inc. of Minneapolis, Minn., can be wrapped around the container to heat the sample and a similar insulating cylinder can be used. CAT scans are performed at two different X-ray tube energies. One scan is performed at an energy that is low enough to be predominantly in the photoelectric region, that is, less than approximately 80 keV mean energy, and the other scan is performed at an energy that is high enough to be predominantly in the Compton region, that is, greater than approximately 80 keV mean energy. Either pre-imaging or post-imaging techniques can be applied to the attenuation coefficients obtained by the dual energy scans to determine the effective atomic number of the core sample. For example, the techniques of Alvarez et al, U.S. Pat. No. 4,029,963, can be used to determine the effective atomic numbers for the plurality of points in each cross section. Preferably, the effective atomic numbers are determined according to the method described hereinbelow.

The energy dependence of the X-ray linear attenuation coefficient $\mu$ is separated into two parts:

$$\mu=\mu_p+\mu_c \tag{1}$$

where $\mu_c$ is the Klein-Nishina function for Compton scattering multiplied by electron density, and $\mu_p$ represents photoelectric absorption (including coherent scattering and binding energy corrections). The photoelectric and Compton contributions are expressed in the form:

$$\mu=aZ^m\rho+b\rho \tag{2}$$

where Z is the atomic number, m is a constant in the range of 3.0 to 4.0, $\rho$ is the electron density, and a and b are energy-dependent coefficients. It should be noted that the specific choice of m depends upon the atomic numbers included in the regression of the photoelectric coefficients. Equation (2) depends on the fact that the energy dependence of the photoelectric cross section is the same for all elements.

For a single element, Z in equation (2) is the actual atomic number. For a mixture containing several elements, the effective atomic number Z* is defined as:

$$Z^* = \sqrt[m]{\sum_i f_i Z_i^m} \tag{3}$$

where $f_i$ is the fraction of electrons on the $i^{th}$ element of atomic number $Z_i$, relative to the total number of electrons in the mixture, that is, $$f_i = \frac{n_i Z_i}{\sum_i n_i Z_i} \tag{4}$$

where $n_i$ is the number of moles of element i.

The method consists of utilizing a CAT to image a core sample at a high and low X-ray energy level. The energies are chosen to maximize the difference in photoelectric and Compton contributions while still allowing sufficient photon flux to obtain good image quality at the lower X-ray energy. Letting 1 and 2 denote the high and low energy images and dividing equation (2) by $\rho$, the following relationships are obtained $$\mu_1/\rho=a_1Z^3+b_1 \tag{5a}$$

$$\mu_2\rho=a_2Z^3+b_2 \tag{5b}$$

Energy coefficients ($a_1$, $b_1$) and ($a_2$, $b_2$) are determined by linear regression of $\mu/\rho$ on $Z^3$ for the high and low energy images, respectively, of calibration materials with a range of known atomic numbers and densities. Once ($a_1$, $b_1$) and ($a_2$, $b_2$) are determined, a material of unknown effective atomic number, $Z^*_x$, can be analyzed in terms of the measured attenuation coefficients $\mu_{1x}$, $\mu_{2x}$:

$$Z^*_x = \sqrt[3]{\frac{1}{a_1}\ \frac{(\mu_{1x}-b_1)}{\rho}} = \sqrt[3]{\frac{-b_1\mu_{2x}+b_2\mu_{1x}}{a_1\mu_{2x}-a_2\mu_{1x}}} \tag{6}$$

Equations (5a) and (5b) are applied to each corresponding pixel of the high and low energy images; these computations can be performed on a minicomputer or other suitable means.

Figure 7:
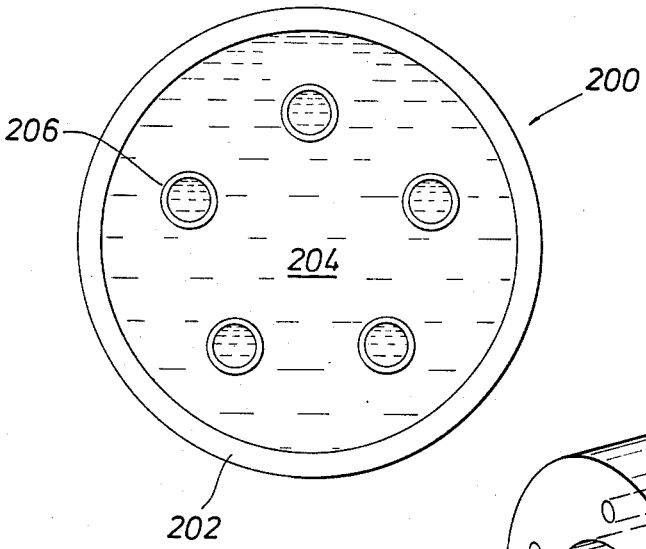
FIG. 7 illustrates a calibration phantom for use with the method of the present invention.

FIG. 7 shows an exemplary phantom 200 used in this method to determine energy dependent coefficients a and b. Phantom 200 consists of a housing 202 made of, for example, plexiglas, which is filled with a liquid 204, for example, water. A number, in this case five, of smaller containers or vials 206 are positioned in liquid 204. Each vial 206 is filled with suitable calibration materials for the sample to be analyzed which have known densities and effective atomic numbers. The range of the effective atomic numbers should be chosen to span those of the sample being tested. For example, typical sedimentary rocks have an effective atomic number in the range of 7.5–15.0 and a density in the range of 1.5–3.0 grams per cubic centimeter.

Figure 8:
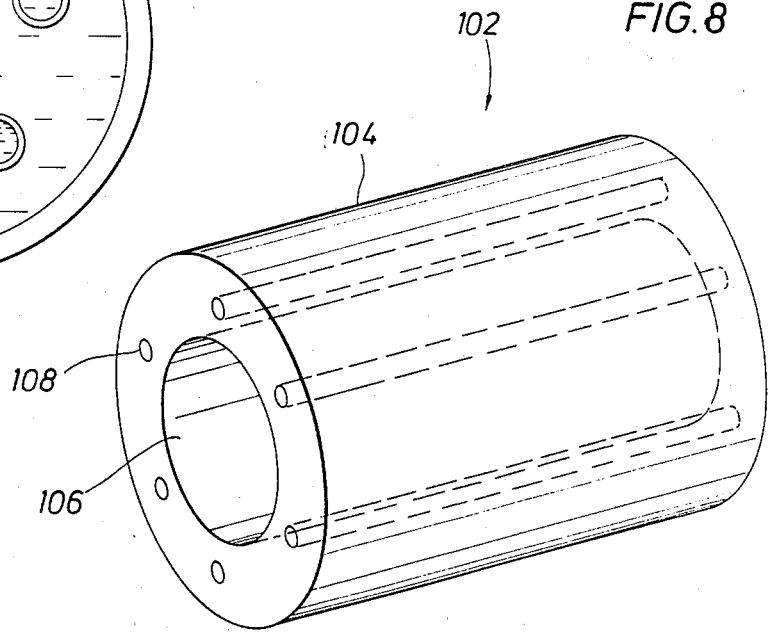
FIG. 8 illustrates a calibration phantom for use with the method of the present invention.

FIG. 8 illustrates a preferred embodiment of a phantom for use with this method. Calibration phantom 102 consists of a cylinder 104 which has an aperture 106 that is suitably sized for holding a sample or sample container. Cylinder 104 which can be made of, for example, plexiglas or other suitable material having low X-ray absorption, contains a plurality of vials or rods 108. Vials or rods 108 should contain or be made of material that is expected to be found in the sample under test. The calibration materials in vials or rods 108 have known densities and effective atomic numbers and should be at least as long as the sample under test. In the case of a core sample rods 108 can be made of aluminum, carbon, fused quartz, crystalline quartz, calcium carbonate, magnesium carbonate and iron carbonate. Alternatively, vials 108 could contain the liquid materials contained in vials 206 of FIG. 7. Referring to FIGS. 2–6 and 8, cylinder 104 can be positioned around tube 56 or it can be an integral part of tube 56. Still further, it can be an integral part of sample holder 74 or positioned in some other known relation in X-ray field 70. It should be noted that calibration phantom 102 is scanned at the same time that the sample is scanned.

Alternatively, the attenuation coefficients measured for the core sample at the low and high energies can be applied to equation (2), and the low energy equation can be divided by the high energy equation to provide a result that is proportional to the effective atomic number raised to the third power. This result is suitable for determining the invasion of the drilling fluid into the core sample.

In the method of the present invention a material, such as barium sulfate, calcium carbonate, sodium tungstate or sodium iodide, is added to the drilling fluid in sufficient quantities to obtain a drilling fluid that has an effective atomic number that is different than the effective atomic number of the connate fluids, that is, brine and hydrocarbons, in the rock formation surrounding the borehold. Generally, an effective atomic number greater than approximately 7.5 is suitable for most applications. If the drilling fluid is oil based rather than water based, then a material such as iodated oil is added.

The depth of invasion of the drilling fluid into the core can be determined from the atomic number map by an operator. This depth can be measured directly from the atomic number map, since the drilling fluid with the added material has an effective atomic number that is different than the connate fluids. Alternatively, the CAT system controller 22 and data processing and recording equipment 20 (FIG. 1) can implement a method that automatically determines the portion of the core that has been invaded by the drilling fluid. A center portion of the core is chosen as the reference, for example, the area defined by the radius of the core divided by four. The average effective atomic number for the reference area for each cross section scanned is determined from the plurality of points scanned in that cross section. Then the average effective atomic number for successively larger annular rings for that cross section are determined and compared with the reference. The annular rings can be increased, for example, by the amount of the radius of the core divided by sixteen. An annular ring that has an average effective atomic number that differs from the average effective atomic number of the reference area of the core by a predetermined amount, for example, five percent, is the innermost annular ring that has been invaded by the drilling fluid.

Other references and test areas can be used, for example, a rectangular section through the center of the core sample. In this case a centrally located rectangle is used as a reference area and successive rectangular areas at increasing radial distances from the center of the core are compared to the reference area as discussed hereinabove. If desired, the depth of invasion for consecutive cross sections can be averaged to provide an average depth of invasion of the drilling fluid into the core.

In an alternative embodiment of the present invention a material, such as sodium tungstate or sodium iodide, which has a K-edge in the range of available X-ray energies can be added to the drilling fluid. The preserved core sample is then scanned at a mean energy that is less than the K-edge energy of the added material and at a mean energy that is greater than the K-edge energy of the added material. Sodium tungstate, for example, has a K-edge at 69.5 keV. The scanning of the preserved core sample at energies above and below the K-edge can be performed by several different methods. Referring to FIG. 1, suitable signals can be provided by system controller 22 to vary the voltage applied to X-ray source 10 by voltage controller 24 to the two desired mean energy levels at each cross section of the core that is scanned. Preferably, the mean X-ray energies are set to be just above and just below the K-edge energy of the material added. The images at the two energies are substracted by data processing and recording equipment 20; the difference is due to the concentration of the added material. Accordingly, a concentration map of the added material is determined. This procedure is performed for the plurality of points scanned at each cross section of the core. The concentration map is then reviewed by an operator by data processing and recording equipment 20 according to the methods described hereinabove in reference to the atomic number map. Alternatively, voltage controller 24 can apply the same voltage to X-ray source 10 for each scan so that the mean X-ray energy is above the K-edge of the material added. System controller 22 supplies suitable control signals to filter controller 26 to apply an appropriate filter to the X-rays during one of the scans. The filter should have a K-edge at or near the K-edge of the material added to the drilling fluid. For example, if sodium tungstate is added to the drilling fluid, a tungsten filter which has a K-edge at 69.5 keV, a tantalum filter which has a K-edge at 67.4 keV or the like, could be used to provide the X-ray image at an energy below the K-edge energy of the added material. A suitable filter passes the X-rays that have an energy just below the K-edge energy of the added material. A suitable filter passes the X-rays that have an energy just below the K-edge energy of the added material and has high attenuation above the K-edge energy. In another embodiment the core sample can be scanned with X-rays that have a mean energy that is just below the K-edge energy of the added material and a filter that has a K-edge at or near the K-edge energy of the added material is applied to the X-rays. The core is then scanned with X-rays that have a mean energy that is above the K-edge energy of the material added. If desired, a second filter material can be applied by filter 16 to the X-rays at the higher energy; this second filter should have a K-edge that is at an energy that is greater than the K-edge energy of the added material. Preferably, the K-edge energy of the second filter should be near the K-edge of the added material. For example, lead which has a K-edge at 88.0 keV could be used with sodium tungstate. The use of two filters provides a narrow band of X-ray energies on each side of the K-edge of the added material. The manual or processing steps discussed hereinabove with reference to the atomic number map can be utilized in any of the foregoing concentration map methods.

For use in the method of the present invention, filter 16, as shown in FIG. 1, should have at least two or three positions depending upon the embodiment of the present invention implemented. One position can contain no filtering material, and a second position can contain a filtering material that has a K-edge at approximately the same K-edge as the material added to the drilling fluid. Preferably, the filter material should have the same K-edge as the added material, for example, a tungsten filter is used when sodium tungstate is added to the drilling fluid. However, a filter having a K-edge close to the K-edge of the material added to the drilling fluid can be used, for example, sodium tungstate has a K-edge at 69.5 keV and a tantalum filter has a K-edge at 67.4 keV. The third position of filter 16 can contain a filter material that has a K-edge that is at an energy that is greater than the K-edge energy of the material added to the drilling fluid. For example, lead which has a K-edge at 88 keV can be used in the case where sodium tungstate has been added to the drilling fluid and a tungsten filter has been used. As discussed hereinabove, filter 16 can be applied to the X-rays prior to their entering the core sample or after their passage through the core sample. With reference to FIG. 1, filter controller 26 positions filter 16 at the appropriate position indicated by system controller 22. Filter controller 26 can employ three light sources, such as photodiodes, and a detector, such as a phototransistor, to operate a motor to move filter 16 to the desired position, which is indicated by the light source that is activated. The photodiodes are positioned behind slits in a plate on the stationary portion of filter 16, and the detector is positioned on the movable portion of filter 16 which moves the desired filter material in front of the X-ray detector. The phototransistor can also be positioned behind a plate which has a small aperture to ensure proper alignment of the filter material.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the foregoing disclosure.

In an alternative embodiment a material can be added to the drilling fluid which changes the attennuation coefficient of the drilling fluid by changing either the atomic number or density or both. The core is scanned at a single energy to determine an attenuation coefficient image. The attenuation coefficient image can be reviewed by an operator or automatically, as described hereinabove, to determine the portion of the core that has a higher attenuation coefficient as an indication of the drilling fluid invasion.

What is claimed is:

1. A method of determining the invasion of drilling fluid into a core sample from a borehole, said method comprising the steps of: adding a first material to the drilling fluid to obtain a first fluid that has an effective atomic number that is different than the effective atomic number of the connate fluids in the rock formation surrounding said borehole; collecting a preserved core sample from said borehole; scanning said core sample with a computerized axial tomographic scanner (CAT) at a first energy to determine the attenuation coefficient at a plurality of points in a cross section of said core sample at said first energy; scanning said core sample with a CAT at a second energy to determine the attenuation coefficient at said plurality of points in said cross section of said core sample at said second energy; using the attenuation coefficients determined for said core sample at said first and second energies to determine an atomic number image for said cross section of said core sample; determining from said atomic number image the depth of invasion of said first fluid into said core sample as an indication of the depth of invasion of said drilling fluid.

2. A method as recited in claim 1, wherein said step of adding a first material comprises adding said first material to the drilling fluid to obtain a first fluid that has an effective atomic number that is greater than 7.5.

3. A method as recited in claim 1, wherein said step of determining the depth of invasion of said first fluid comprises: determining the average effective atomic number for a reference area near the center of said core sample; determining the average effective atomic number for a plurality of areas that are positioned at different distances from the center of said core sample; and comparing the average effective atomic number for said reference area with the average effective atomic numbers for said plurality of areas to determine which of said plurality of areas has an average effective atomic number that is greater than the average effective atomic number of said reference area by a predetermined amount as an indication of the depth of invasion of said drilling fluid into said core sample.

4. A method as recited in claim 3, wherein said step of determining the average effective atomic number for a plurality of areas comprises determining the average effective atomic number for a plurality of areas that are positioned at increasing greater distances from the center of said core sample.

5. A method as recited in claim 4, wherein said comparing step comprises comparing the average effective atomic number for said reference area with said average effective atomic number for said plurality of areas to determine the area in said plurality of areas that is closest to the center of said core sample and is greater than said average effective atomic number for said reference area by a predetermined amount.

6. A method as recited in claim 5, wherein said step of determining the average effective atomic number for said reference area comprises determining the average effective atomic number for a circular area having a predetermined radius from the center of said core sample.

7. A method as recited in claim 6, wherein said step of determining the average effective atomic number for said plurality of areas comprises determining the average effective atomic number for a plurality of annular areas.

8. A method of determining the invasion of drilling fluid into a core sample from a borehole, said method comprising the steps of: adding a first material havng a K-edge at a first energy to the drilling fluid; collecting a preserved sample from said borehole; scanning said core sample with a computerized axial tomographic scanner (CAT) at a second mean energy that is less than said first energy to determine the attenuation coefficients at a plurality of points in a cross section of said core sample at said second energy; scanning said core sample with a CAT at a third mean energy that is greater than said first energy to determine the attenuation coefficients at said plurality of points in said cross section at said third energy; using the attenuation coefficients determined for said core sample at said second and third energies to determine a concentration map of said first material in said cross section; determining from said concentration map the depth of invasion into said core sample of said first material as an indication of the depth of invasion of said drilling fluid.

9. A method as recited in claim 8, wherein said step of scanning said core sample with a CAT at said second energy comprises radiating said core sample with radiation at said second energy and said step of scanning said core sample with a CAT at said third energy comprises radiating said core sample with radiation at said third energy.

10. A method as recited in claim 8, wherein said step of scanning said core sample with a CAT at said third energy comprises radiating said core with radiation at said third energy and said step of scanning said core sample with a CAT at said second energy comprises radiating said core sample with radiation at said third energy and filtering said radiation at said third energy to obtain radiation at said second energy.

11. A method as recited in claim 10, wherein said filtering step comprises filtering said radiation at said third energy with a filter having a K-edge at approximately said first energy.

12. A method as recited in claim 9, wherein said step of radiating said core sample with radiation at said second energy comprises filtering said radiation at said second energy with a filter having a K-edge at approximately said first energy.

13. A method as recited in claim 9, wherein said step of radiating said core sample with radiation at said second energy comprises filtering said radiation at said second energy with a filter having a K-edge at approximately said first energy and said step of radiating said core with radiation at said third energy comprises filtering said radiation at said third energy with a filter having a K-edge at an energy that is greater than said first energy.

14. A method as recited in claim 8, wherein said step of determining the depth of invasion of said first material comprises: determining the average concentration of said first material for a reference area near the center of said core sample; determining the average concentration of said first material for a plurality of areas that are positioned at different distances from the center of said core sample; and comparing the average concentration of said first material for each said reference area with the average concentration of said first material for of said plurality of areas to determine which of said plurality of areas has an average concentration of said first material that is greater than the average concentration of said first material of said reference area by a predetermined amount as an indication of the depth of invasion of said drilling fluid into said core sample.

15. A method as recited in claim 14, wherein said step of determining the average concentration of said first material for a plurality of areas comprises determining the average concentration of said first material for a plurality of areas that are positioned at increasing greater distances from the center of said core sample.

16. A method as recited in claim 15, wherein said comparing step comprises comparing the average concentration of said first material for said reference area with said average concentration of said first material for said plurality of areas to determine the area in said plurality of areas that is closest to the center of said core sample and is greater than said average concentration of said first material for said reference area by a predetermined amount.

17. A method as recited in claim 16, wherein said step of determining the average concentration of said first material for said reference area comprises determining the average concentration of said first material for a circular area having a predetermined radius from the center of said core sample.

18. A method as recited in claim 17, wherein said step of determining the average concentration of said first material for said plurality of areas comprises determining the average concentration of said first material for a plurality of annular areas.

19. A method as recited in claim 8, wherein said step of using the attenuation coefficients determined for said core sample at said second and third energies to determine a concentration map of said first material in said cross section comprises subtracting the attenuation coefficients at either said second or third energy at said plurality of points in said cross section from the attenuation coefficients at said plurality of points in said cross section at the other of said second and third energies to determine a concentration map of said first material in said cross section.

20. A method of determining the invasion of drilling fluid into a core sample from a borehole, said method comprising the steps of: adding a first material to the drilling fluid to obtain a first fluid that has either an effective atomic number that is different than the effective atomic number of the connate fluids in the rock formation surrounding said borehole or a density that is different than the density of the connate fluids in the rock formation surrounding said borehole or both; collecting a preserved core sample from said borehole; scanning said core sample with a computerized axial tomographic scanner (CAT) at a first energy to determine the attenuation coefficient at a plurality of points in a cross section of said core sample at said first energy; determining from said attenuation coefficients for said plurality of points the depth of invasion of said first fluid into said core sample as an indication of the depth of invasion of said drilling fluid.

21. A method as recited in claim 20, wherein said step of determining the depth of invasion of said first fluid comprises; determining the average attenuation coefficient for a reference area near the center of said core sample; determining the average attenuation coefficient for a plurality of areas that are positioned at different distances from the center of said core sample; and comparing the average attenuation coefficient for said reference area with the average attenuation coefficients for said plurality of areas to determine which of said plurality of areas has an average attenuation coefficient that is greater than the average attenuation coefficient of said reference area by a predetermined amount as an indication of the depth of invasion of said drilling fluid into said core sample.

22. A method as recited in claim 21, wherein said step of determining the average attenuation coefficient for a plurality of areas comprises determining the average attenuation coefficient for a plurality of areas that are positioned at increasing greater distances from the center of said core sample.

23. A method as recited in claim 22, wherein said comparing step comprises comparing the average attenuation coefficient for said reference area with said average attenuation coefficient for said plurality of areas to determine the area in said plurality of areas that is closest to the center of said core sample and is greater than said average attenuation coefficient for said reference area by a predetermined amount.

24. A method as recited in claim 23, wherein said step of determining the average attenuation coefficient for said reference area comprises determining the average attenuation coefficient for a circular area having a predetermined radius from the center of said core sample.

25. A method as recited in claim 24, wherein said step of determining the average attenuation coefficient for said plurality of areas comprises determining the average attenuation coefficient for a plurality of annular areas.

* * * * *